US010603715B2

(12) United States Patent
Robbins

(10) Patent No.: US 10,603,715 B2
(45) Date of Patent: Mar. 31, 2020

(54) DIE-CASTING PISTON, AND DIE-CASTING APPARATUS INCORPORATING SAME

(71) Applicant: EXCO TECHNOLOGIES LIMITED, Markham (CA)

(72) Inventor: Paul Henry Robbins, Port Perry (CA)

(73) Assignee: Exco Technologies Limited, Markham (CA)

( * ) Notice: Subject to any disclaimer, the term of this patent is extended or adjusted under 35 U.S.C. 154(b) by 0 days.

(21) Appl. No.: 15/854,989

(22) Filed: Dec. 27, 2017

(65) Prior Publication Data

US 2018/0185910 A1 Jul. 5, 2018

Related U.S. Application Data

(60) Provisional application No. 62/440,403, filed on Dec. 30, 2016.

(51) Int. Cl.

| | |
|---|---|
| ***B22D 17/20*** | (2006.01) |
| ***B22D 17/14*** | (2006.01) |
| ***B22D 17/22*** | (2006.01) |
| *B22D 25/06* | (2006.01) |

(52) U.S. Cl.

CPC ..... *B22D 17/203* (2013.01); *B22D 17/14* (2013.01); *B22D 17/2023* (2013.01); *B22D 17/2038* (2013.01); *B22D 17/2209* (2013.01); *B22D 17/2263* (2013.01); *B22D 25/06* (2013.01)

(58) Field of Classification Search

CPC .. B22D 17/203; B22D 17/14; B22D 17/2023; B22D 17/2038; B22D 17/2209; B22D 17/2263; B22D 25/06

See application file for complete search history.

(56) References Cited

U.S. PATENT DOCUMENTS

| | | | | |
|---|---|---|---|---|
| 5,048,592 | A | 9/1991 | Mueller | |
| 5,233,912 | A * | 8/1993 | Mueller | B22D 17/203 277/451 |
| 6,454,880 | B1 * | 9/2002 | Rickman, Jr. | C21D 1/78 148/218 |
| 7,900,552 | B2 | 3/2011 | Schivalocchi et al. | |
| 8,136,574 | B2 | 3/2012 | Muller et al. | |
| 2007/0163743 | A1 * | 7/2007 | Go | B22D 17/14 164/113 |
| 2015/0107796 | A1 * | 4/2015 | Robbins | B22D 17/14 164/254 |

FOREIGN PATENT DOCUMENTS

| | | | |
|---|---|---|---|
| KR | 20090093594 A * | 9/2009 | |
| WO | WO-2014161101 A1 * | 10/2014 | B22D 17/203 |

OTHER PUBLICATIONS https://www.azom.com/article.aspx?ArticleID=6772 (Year: 2012).*

* cited by examiner

*Primary Examiner* — Kevin P Kerns
*Assistant Examiner* — Steven S Ha

(57) ABSTRACT

A piston of a die-casting apparatus comprises: a piston head fabricated of a first material; an elongate, inner carrier coupled to the piston head; a generally annular body seated on the carrier adjacent the piston head; and a wear ring disposed on the piston head, the wear ring being fabricated of a second material. The first material has a higher toughness and a lower hardness than the second material.

19 Claims, 14 Drawing Sheets

DIE-CASTING PISTON, AND DIE-CASTING APPARATUS INCORPORATING SAME

CROSS-REFERENCE TO RELATED APPLICATION

This application claims the benefit of U.S. Provisional Application No. 62/440,403 to Robbins filed on Dec. 30, 2016, the entire content of which is incorporated herein by reference.

FIELD

The subject disclosure relates generally to die-casting and in particular, to a die-casting piston and a die-casting apparatus incorporating the same.

BACKGROUND

In the field of automotive manufacturing, structural components that historically have been fabricated of steel, such as engine cradles, are increasingly being replaced with aluminum alloy castings. Such castings are typically large, convoluted, and relatively thin, and are required to meet the high quality standards of automotive manufacturing. In order to meet these requirements, vacuum-assisted die-casting is typically used to produce such castings.

Vacuum-assisted die-casting machines comprise a piston, sometimes referred to as a "plunger", that is advanced through a piston bore, sometimes referred to as a "shot sleeve", to push a volume of liquid metal into a mold cavity. Vacuum is applied to the piston bore to assist the flow of the liquid metal therethrough. A replaceable wear ring is fitted onto the piston, and makes continuous contact with the inside of the piston bore along the full stroke of the piston for providing a seal for both the vacuum and liquid metal. The wear ring sits freely on a circumferential rib rearward of the front face of the piston head, and is split to allow it to be installed onto the piston head prior to use, and to be removed from the piston head after use.

For example, FIG. 1 shows a portion of a prior art vacuum-assisted die-casting apparatus, which is generally indicated by reference numeral 20. Vacuum-assisted die-casting apparatus 20 comprises a piston that is moveable within a piston bore 22 defined within a shot sleeve 24 for pushing a volume of liquid metal (not shown) into a die-casting mold cavity (not shown) to form a casting. In the example shown, the piston is positioned at its starting position of the stroke, which is rearward of a port 26 through which the volume of liquid metal is introduced into the piston bore 22.

The piston comprises a piston head 30 mounted on a forward end of a piston stem (not shown). The piston head 30 has a front face 32 that is configured to contact the volume of liquid metal introduced into the piston bore 22 via port 26. The piston head 30 has a wear ring 34 disposed on an outer surface thereof.

In operation, at the beginning of a stroke cycle, the piston is positioned at its starting position in the piston bore 22, and a volume of liquid metal is introduced into the piston bore 22 forward of the piston head 30 via port 26. The piston is then moved forward through the piston bore 22 to push the volume of liquid metal into the mold cavity for forming a metal casting, and is then moved rearward to its starting position to complete the stroke cycle. During this movement, the wear ring 34 disposed on the piston head 30 continuously contacts the surface 38 of the piston bore 22, and provides a liquid metal seal for preventing liquid metal from passing between the piston head 30 and the surface 38 of the piston bore 22. The wear ring 34 also provides a vacuum seal for maintaining vacuum (that is, a low pressure) within the forward volume of the piston bore 22. The cycle is repeated, as desired, to produce multiple metal castings.

Other die-casting pistons have been described. For example, U.S. Pat. No. 5,048,592 to Mueller discloses a plunger for forcing molten aluminum or brass out of a casting cylinder of a die-casting machine. The plunger includes a cap that is screwed via an internal thread onto an external thread of a supporting body and is made of a material, in particular a copper alloy, which has a greater coefficient of thermal expansion than the material of the cylinder, in particular steel, and the material of the supporting body, in particular steel. In one embodiment, the cap has on its outer cover face a cylindrical extension with an outer annular web, which engages into a corresponding inner annular groove of a sealing ring. The sealing ring is split radially in a step shape.

U.S. Pat. No. 7,900,552 to Schivalocchi et al. discloses a piston for a cold chamber die-casting machine comprising a body and at least one sealing band mounted around the body. The body and the band are provided with coupling means for obtaining both an angular locking and an axial locking of the band to the piston body.

U.S. Pat. No. 8,136,574 to Müller et al. discloses a multi-piece piston for fixing to a high pressure side end of a piston rod running axially in a casting cylinder of a cold chamber casting machine. The piston comprises a piston crown forming a piston front face on the high pressure side and a piston body in the form of a bush connected to the piston crown on the low pressure side. Complementary bayonet locking means are provided for axial fixing of the piston to the end of the piston rod, on the piston crown and the end.

Improvements are generally desired. It is an object at least to provide a novel die-casting piston, and a die-casting apparatus incorporating the same.

SUMMARY OF THE INVENTION

Accordingly, in one aspect there is provided a piston of a die-casting apparatus, the piston comprising: a piston head fabricated of a first material; an elongate, inner carrier coupled to the piston head; a generally annular body seated on the carrier adjacent the piston head; and a wear ring disposed on the piston head, the wear ring being fabricated of a second material, the first material having a higher toughness and a lower hardness than the second material.

The body may be fabricated of the first material.

The first material may be shock-resistant tool steel. The first material may be AISI grade 4340 steel, AISI grade 300M steel, or AISI grade 4140 steel, or any non-AISI equivalent thereof.

The first material may be a tool steel having composition comprising, in weight percentage: from about 0.32% to about 0.48% carbon (C); from about 0.50% to about 1.50% chromium (Cr); from about 0.40% to about 1.30% manganese (Mn); from about 0.05% to about 0.90% molybdenum (Mo); and iron (Fe). The composition may further comprise, in weight percentage, from about 0.36% to about 0.48% carbon (C). The composition may further comprise, in weight percentage, from about 0.37% to about 0.46% carbon (C). The composition may further comprise, in weight percentage, from about 0.70% to about 1.10% chromium (Cr). The composition may further comprise, in weight percentage, from about 0.70% to about 0.95% chromium (Cr). The composition may further comprise, in weight percentage, from about 0.50% to about 1.10% manganese (Mn). The composition may further comprise, in weight percentage, from about 0.60% to about 1.00% manganese (Mn). The composition may further comprise, in weight percentage, from about 0.10% to about 0.80% molybdenum (Mo). The composition may further comprise, in weight percentage, from about 0.15% to about 0.65% molybdenum (Mo).

The second material may be hot-worked tool steel. The second material may be AISI grade H13 steel or DIN grade 1.2344 steel.

The carrier may comprise a circumferential baffle rib formed on an outer surface thereof, the baffle rib having at least one cutout formed therein and sized to allow cooling fluid to flow therethrough. The body may comprise an inwardly projecting circumferential baffle ring configured to abut an outer circumferential surface of the baffle rib to provide a fluid baffle. The baffle rib and the baffle ring may be coplanar around a full revolution about a longitudinal axis of the carrier. The baffle rib and the baffle ring may define a shared plane that is perpendicular to the longitudinal axis. The carrier may comprise a first baffle rib having at least one first cutout formed therein, and a second baffle rib comprising at least one second cutout formed therein, the at least one first cutout being angularly offset relative to the at least one second cutout about a longitudinal axis of the carrier. The body may comprise a first inwardly projecting circumferential baffle ring configured to abut an outer circumferential surface of the first baffle rib to provide a first fluid baffle, and a second inwardly projecting circumferential baffle ring configured to abut an outer circumferential surface of the second baffle rib to provide a second fluid baffle. The first baffle rib and the first baffle ring may be coplanar around a full revolution about a longitudinal axis of the carrier, and the second baffle rib and the second baffle ring are coplanar around a full revolution about the longitudinal axis of the carrier. The first baffle rib and the first baffle ring may define a first shared plane that is perpendicular to the longitudinal axis, and wherein the second baffle rib and the second baffle ring define a second shared plane that is perpendicular to the longitudinal axis.

The body may have an additional wear ring disposed thereon.

The body may have a wear band disposed thereon.

The piston head and the body have a unitary construction. The piston head and the body may be fabricated of a single piece of the first material.

In one embodiment, there is provided a die-casting apparatus comprising the above-described piston. The die-casting apparatus may be a vacuum die-casting apparatus.

BRIEF DESCRIPTION OF THE DRAWINGS

Embodiments will now be described more fully with reference to the accompanying drawings in which.

DETAILED DESCRIPTION OF THE EMBODIMENTS

Figure 1:
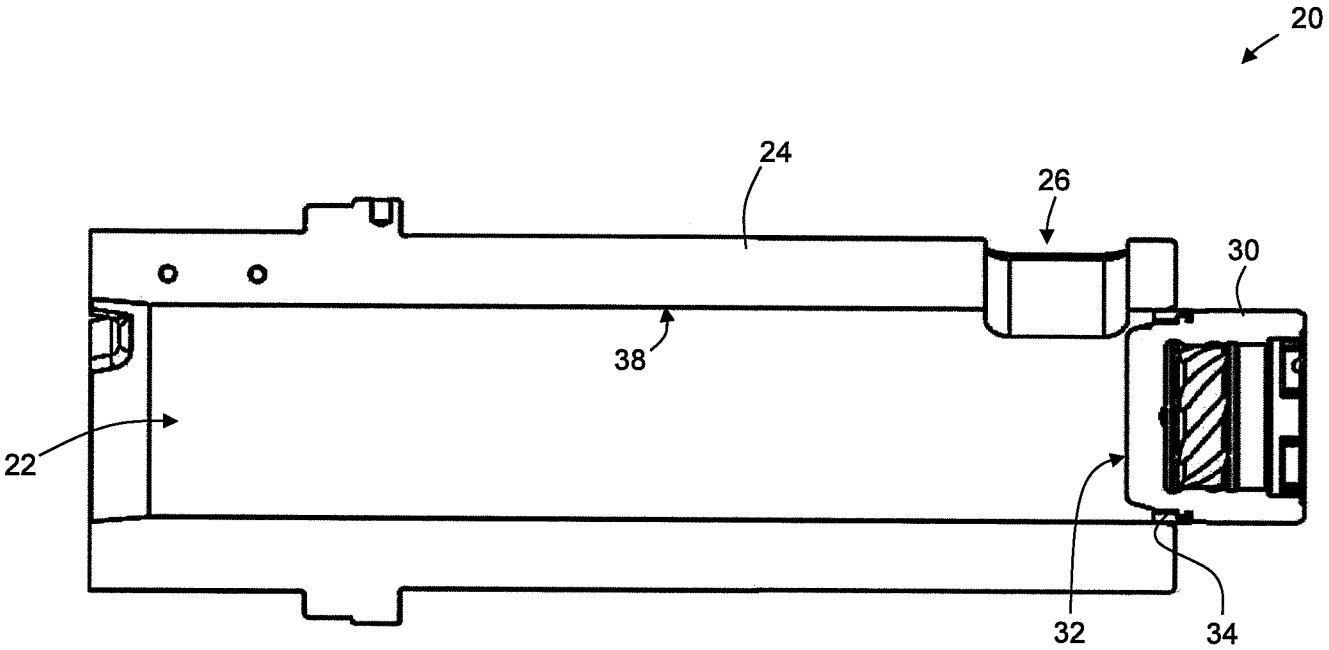
Figure 1 (PRIOR ART)
FIG. 1 is a sectional side view of a portion of a prior art die-casting apparatus, comprising a prior art piston.
Figure 2:
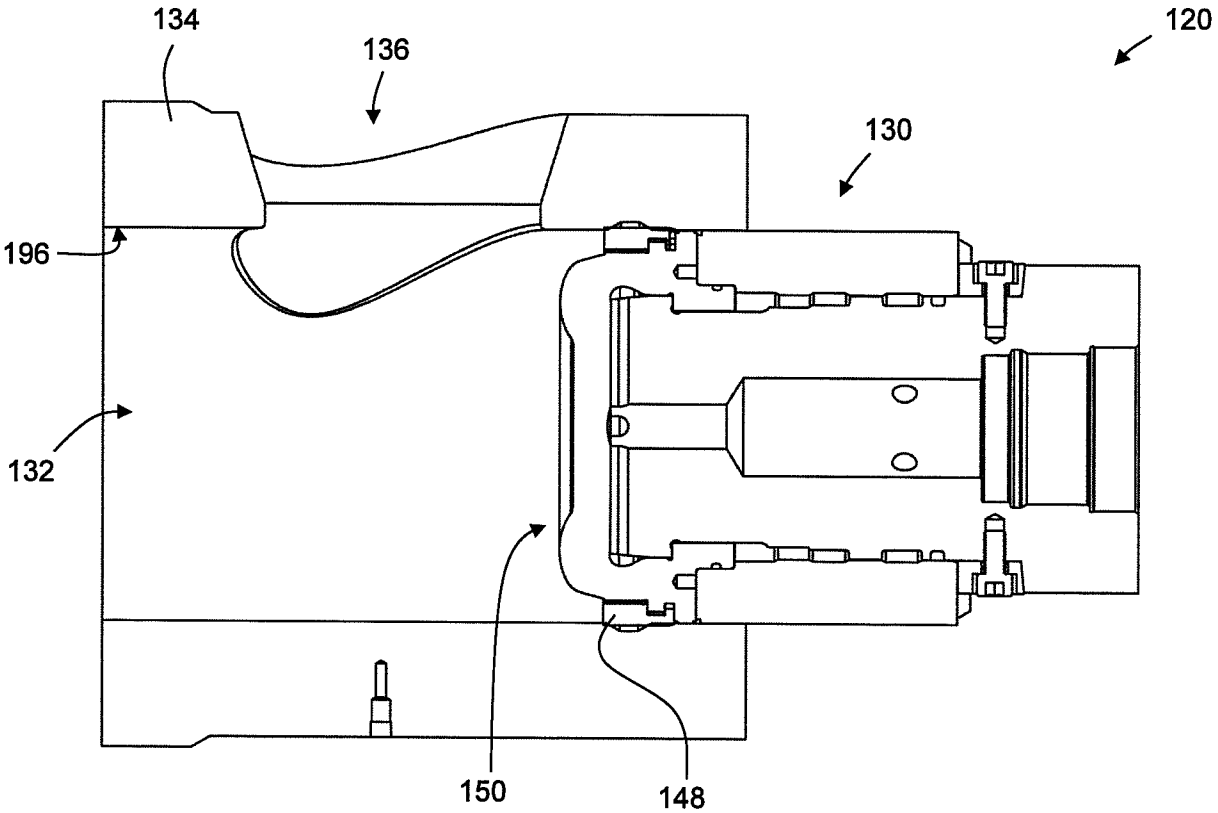
FIG. 2 is a sectional side view of a portion of a die-casting apparatus, comprising a piston.
Figure 3:
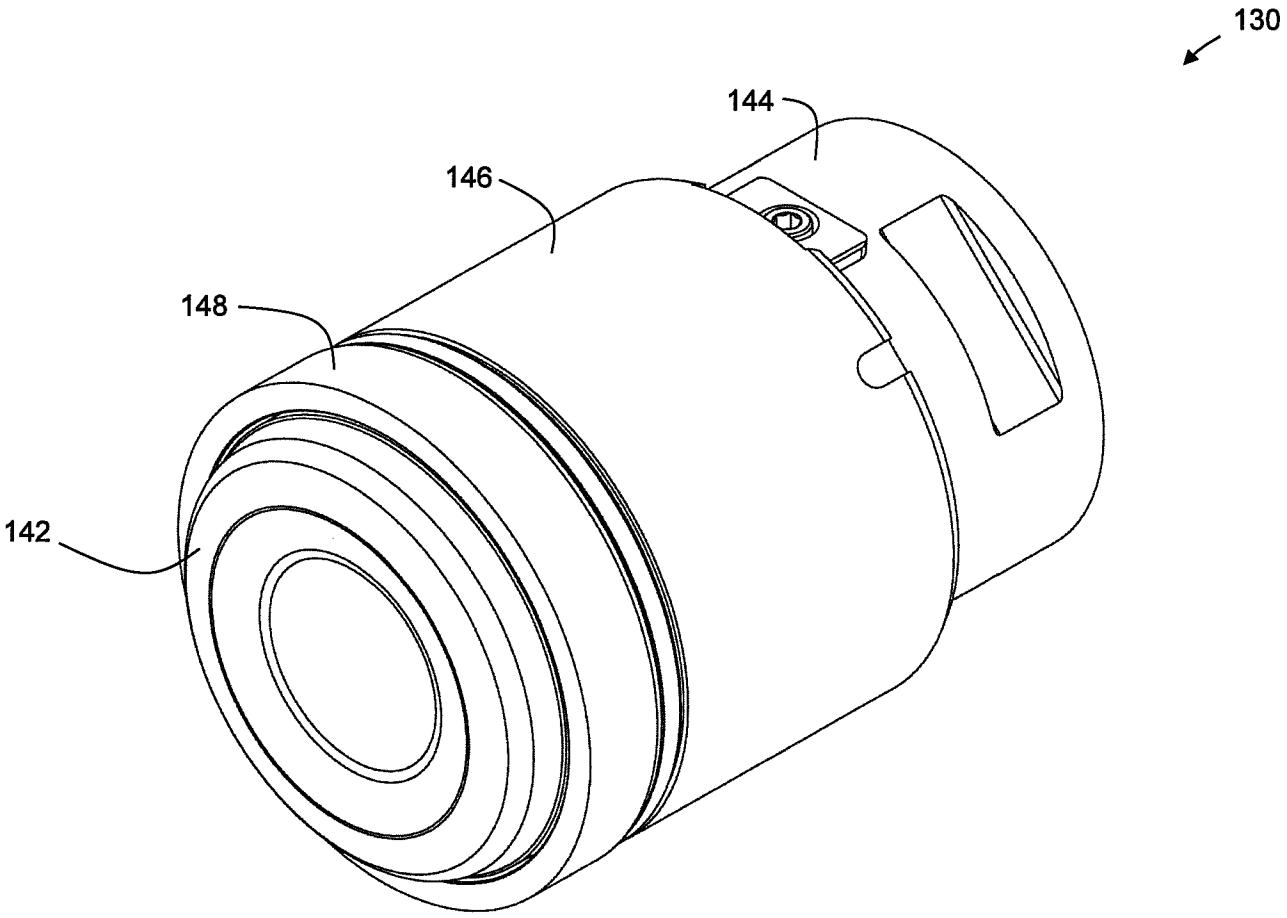
FIG. 3 is a perspective view of the piston of FIG. 2.
Figure 4:
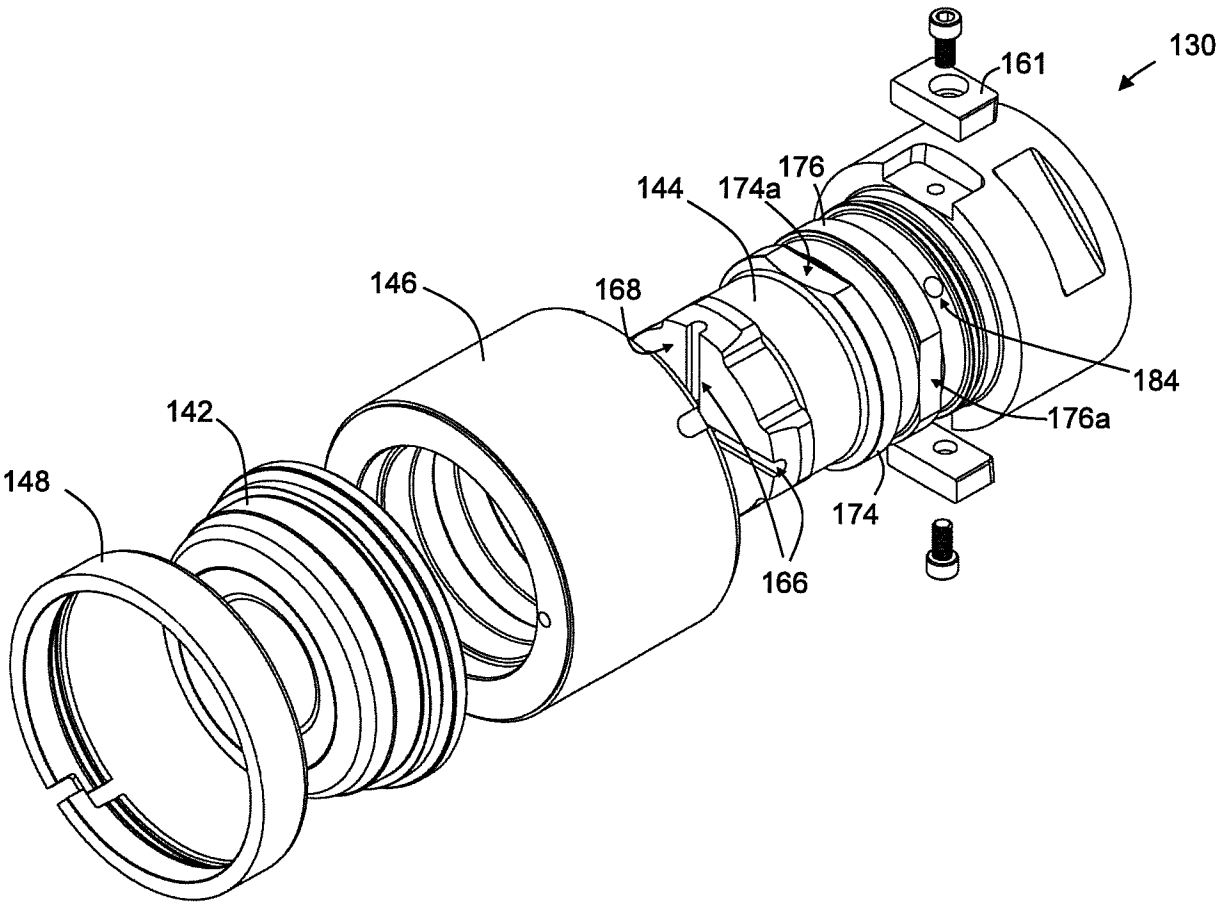
FIG. 4 is an exploded perspective view of the piston of FIG. 2.
Figure 5:
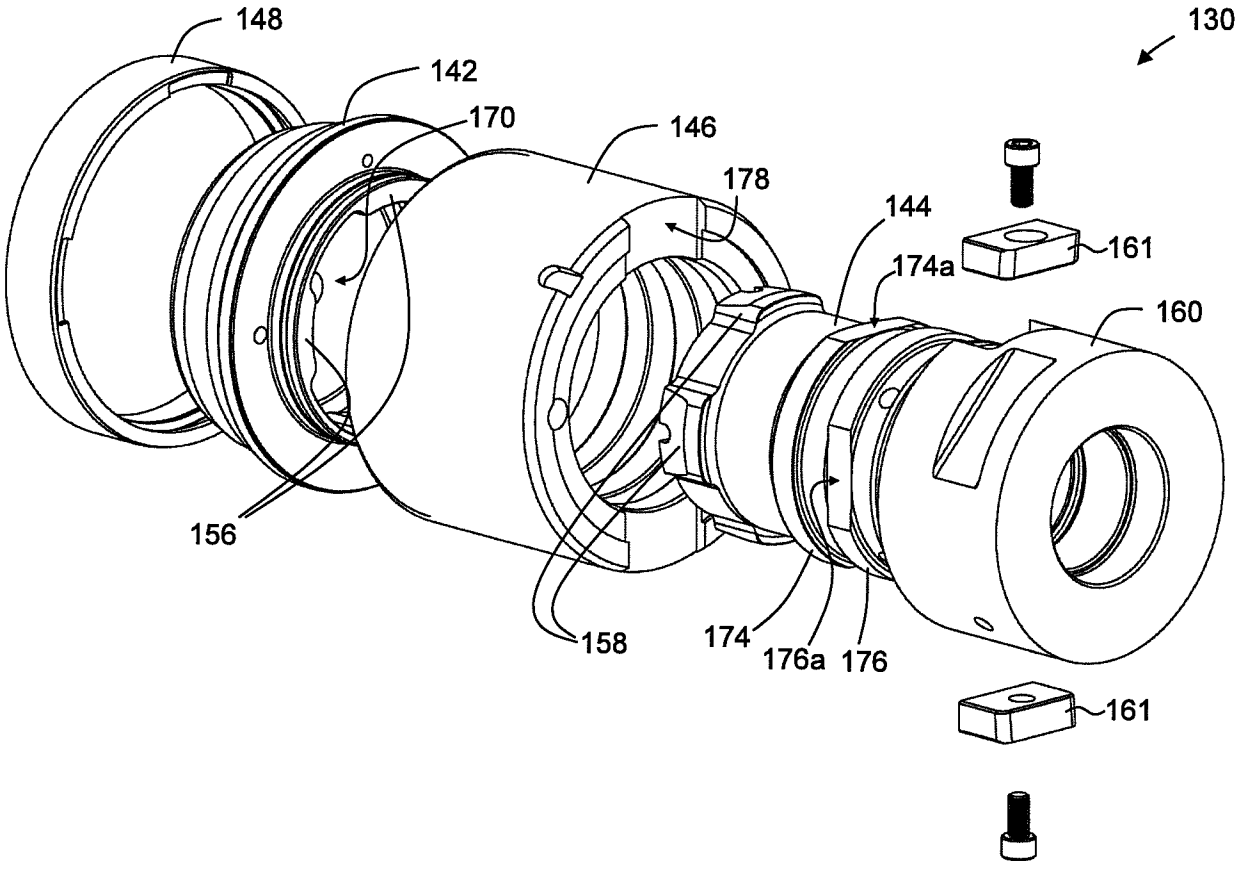
FIG. 5 is another exploded perspective view of the piston of FIG. 2.

Turning now to FIG. 2, a portion of a vacuum-assisted die-casting apparatus is shown, and is generally indicated by reference numeral 120. Vacuum-assisted die-casting apparatus 120 comprises a piston 130 that is moveable within a piston bore 132 defined within a shot sleeve 134 for pushing a volume of liquid metal (not shown) into a die-casting mold cavity (not shown) to form a casting. The shot sleeve 134 comprises a port 136 through which the volume of liquid metal is introduced into the piston bore 132, and in the example shown, the piston 130 is positioned at its starting position of the stroke, which is rearward of the port 136.

The piston 130 may be better seen in FIGS. 3 to 8. The piston 130 is configured to be mounted on a forward end of a piston stem (not shown). The piston 130 comprises a piston head 142, an inner piston carrier 144 coupled to the piston head 142, a piston body 146 seated on the carrier 144 and coupled to the piston head 142, and a replaceable wear ring 148 disposed on an outer surface of the piston head 142.

The piston head 142 comprises a generally cup-shaped body that has a front face 150 configured to contact the volume of liquid metal introduced into the piston bore 132 via port 136. In the embodiment shown, the front face 150 has a depression formed therein. The piston head 142 has a circumferential rib 152 and a circumferential groove formed on an outer surface thereof for engaging the wear ring 148. The piston head 142 defines an internal cavity 154, and has a set of inwardly projecting lugs 156 that are configured to provide a bayonet-style connection with the carrier 144. The piston head 142 is fabricated of a tool steel that has a higher toughness and a higher yield strength than hot-worked tool steel, and in this embodiment the piston head 142 is fabricated of AISI grade 4340 steel.

The carrier 144 comprises an elongate, generally cylindrical body that has a plurality of outwardly extending lugs 158 formed at its forward end. The lugs 158 cooperate with the lugs 156 to provide a bayonet-style connection with the piston head 142 when the carrier 144 and the piston head 142 are rotated into position and coupled in the assembled piston 130. The carrier 144 comprises a collar 160 formed at its aft end. The collar 160 has a forward surface configured to abut against the body 146 in the assembled piston 130. The collar 160 also has a pair of slots formed therein adjacent the forward surface, with each slot being shaped to accommodate a respective locking key 161. Each locking key 161 is connectable to the carrier 144 by a fastener, and in the embodiment shown the fastener is a screw.

Figure 6:
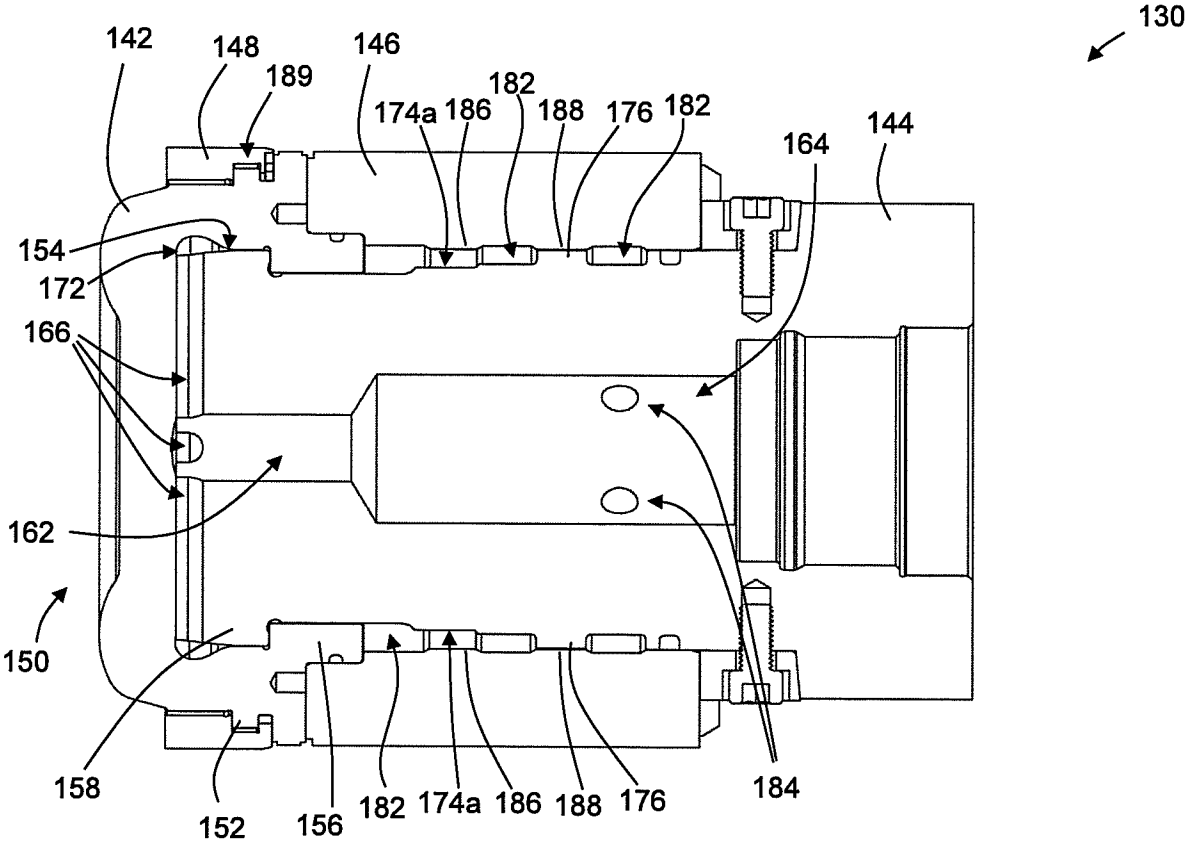
FIG. 6 is a sectional side view of the piston of FIG. 2.
Figure 7:
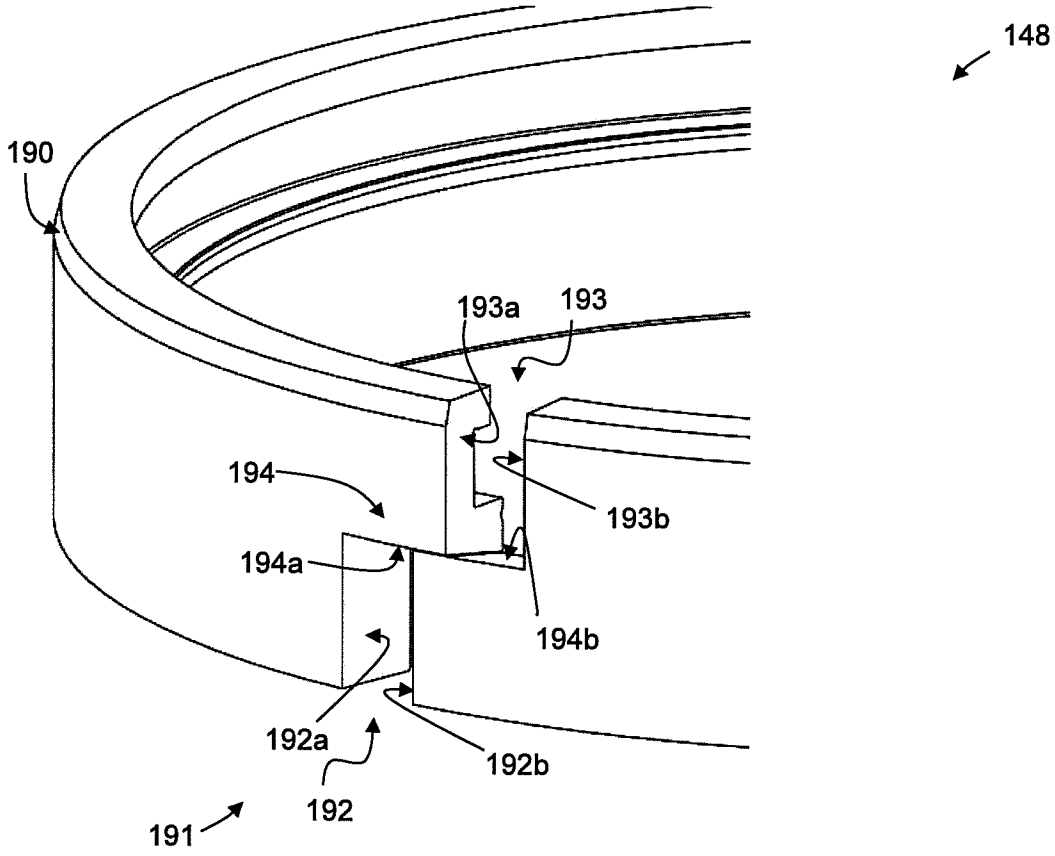
FIG. 7 is a perspective view of a portion of a wear ring forming part of the piston of FIG. 2.
Figure 8:
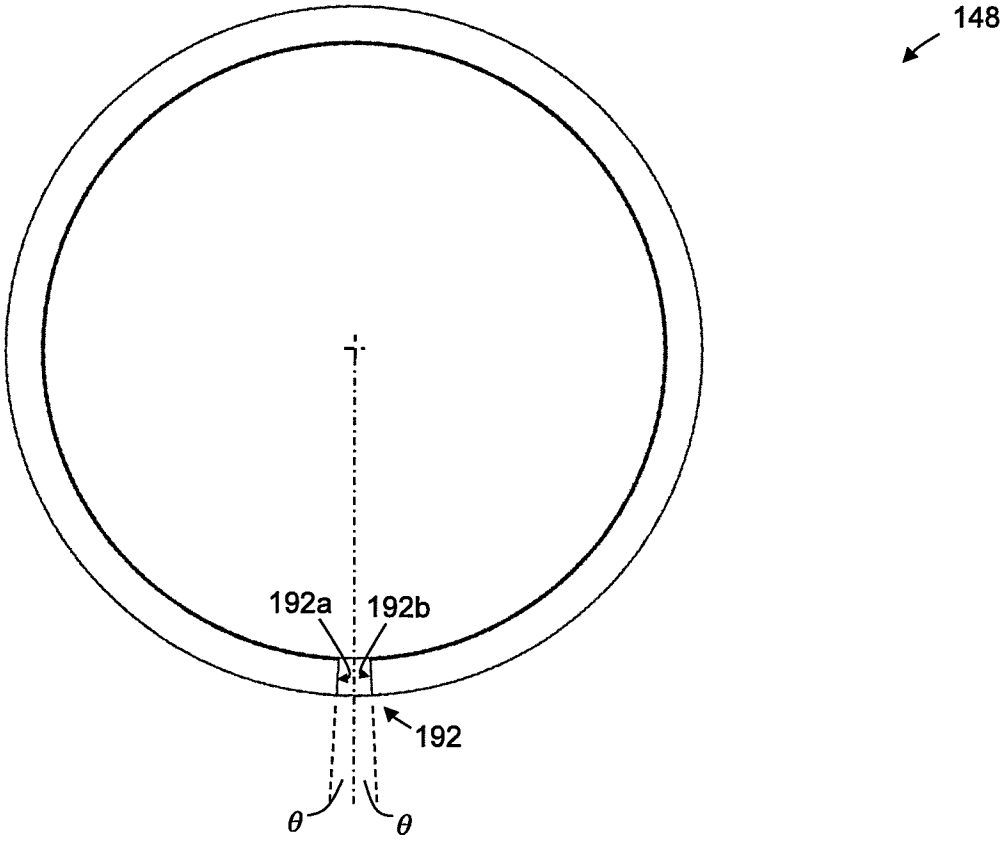
FIG. 8 is a front view of the wear ring of FIG. 7.

The carrier 144 has a plurality of internal conduits for circulating cooling fluid within the interior of the piston 130. The cooling fluid is delivered to and removed from the carrier 144 through conduits (not shown) in the interior of the piston stem. In this embodiment, the cooling fluid is water, although another cooling fluid (such as air, for example) may alternatively be used. The internal conduits comprise a forward internal conduit 162 for delivery of cooling fluid, and a rear internal conduit 164 for removal of cooling fluid. The forward internal conduit 162 is in fluid communication with a plurality of radial grooves 166 formed in a front face 168 of the carrier 144 and that extend outwardly across the lugs 158. As shown in FIG. 6, the front face 168 of the carrier 144 abuts an inner surface 170 of the piston head 142 when the carrier 144 and the piston head 142 are coupled in the assembled piston 130. The radial grooves 166 are configured to convey the cooling fluid across the inner surface 170 of the piston head 142, and into an annular channel 172 defined within the internal cavity 154 of the piston head 142. The carrier 144 comprises two (2) circumferential baffle ribs, namely a first baffle rib 174 and a second baffle rib 176, formed on an outer surface of the carrier 144 rearward of the lugs 158. The first baffle rib 174 has two cutouts 174*a* formed therein that are sized to allow cooling fluid to flow therethrough. Similarly, the second baffle rib 176 has two cutouts 176*a* formed therein that are sized to allow cooling fluid to flow therethrough. In the example shown, the cutouts are formed such that the cutouts 174*a* of the first baffle rib 174 are angularly offset by an angle of about 90 degrees relative to the cutouts 176*a* of the second baffle rib 176, about the longitudinal axis of the carrier 144. As will be understood, the angular offset of the cutouts 174*a* relative to the cutouts 176*a* ensures that the cooling fluid travels a more circuitous rearward path through the interior of the piston 130.

The body 146 has a generally annular shape, and has a forward surface configured to abut against the piston head 142 and a rear surface configured to abut against the collar 160 in the assembled piston 130. The rear surface of the body 146 has two (2) notches 178 formed therein, with each notch 178 being sized to accommodate a respective locking key 161 for preventing rotation of the body 146 and the carrier 144 in the assembled piston 130. The body 146 also has an inner surface that is generally spaced from an outer surface of the carrier 144, such that the body 146 and the carrier 144 define an annular volume 182 within the assembled piston 130. As will be understood, the annular volume 182 is in fluid communication with the annular channel 172 within the internal cavity 154 through gaps (not shown) between adjacent lugs 158, and through gaps (not shown) between adjacent lugs 156. The annular volume 182 is also in fluid communication with the rear internal conduit 164 through ducts 184 within the carrier 144, for circulation of cooling fluid within the interior of the piston 130. The inner surface of the body 146 has two (2) inwardly projecting circumferential baffle rings, namely a first baffle ring 186 and a second baffle ring 188, formed thereon. The first and second baffle rings 186 and 188 are configured to abut the outer circumferential surfaces of the first and second circumferential baffle ribs 174 and 176, respectively, in the assembled piston 130. The baffle rib 174 and the baffle ring 186 provide a first fluid baffle having flow channels defined by cutouts 174*a*, and the baffle rib 176 and the baffle ring 188 provide a second fluid baffle having flow channels defined by cutouts 176*a*. As will be understood, the baffle rib 174 and the baffle ring 186 are coplanar around a full revolution about the longitudinal axis of the carrier 144, with the shared imaginary plane being perpendicular to the longitudinal axis. Similarly, the baffle rib 176 and the baffle ring 188 are coplanar around a full revolution about the longitudinal axis of the carrier 144, with the shared imaginary plane being perpendicular to the longitudinal axis. The body 146 is fabricated of a tool steel that has a higher toughness and a higher yield strength than hot-worked tool steel, and in this embodiment the body 146 is fabricated of AISI grade 4340 steel.

The wear ring 148 has a generally annular shape, and has an inner circumferential groove 189 that is shaped to receive the circumferential rib 152 formed on the outer surface of the piston head 142. The wear ring 148 also has a rear beveled surface 190 for facilitating rearward movement of the piston 130 through the piston bore 132 during operation. The wear ring 148 is fabricated of hot-worked tool steel that has a higher hardness than AISI grade 4340 steel, and in this embodiment the wear ring 148 is fabricated of AISI grade H13 steel or DIN grade 1.2344 steel.

The wear ring 148 further comprises a gap 191 for facilitating installation and removal of the wear ring 148 onto and from the piston head 142. The gap 191 does not extend straight through the wear ring, but rather comprises two or more circumferentially offset pairs of circumferentially spaced apart facing surfaces that are joined together by at least one step or jog. As will be understood, the gap 191 enables the wear ring 148 to expand and contract as needed during operation of the piston 130. The gap 191 is formed by cutting an otherwise continuous ring, and in this embodiment the gap 191 is formed by electronic discharge machining (EDM). The gap 191 comprises a first portion 192 extending in the axial direction and defining circumferentially spaced apart facing surfaces 192*a* and 192*b*, a second portion 193 extending in the axial direction and defining circumferentially spaced apart facing surfaces 193*a* and 193*b*, and an intermediate portion 194 extending in the circumferential direction and joining the first portion 192 and the second portion 193, and defining facing surfaces 194*a* and 194*b*. As may be seen in FIG. 7, the first portion 192 and the second portion 193 are circumferentially offset.

In this embodiment, the first portion 192 and the second portion 193 of the gap 191 are machined using angled cutting. As a result, each of the facing surfaces 192*a* and 192*b* are inwardly angled, such that each of the facing surfaces 192*a* and 192*b* defines an angle θ with a radial line extending through the center of the first portion 192. The radial line bisects the gap between the pair of facing surfaces 192*a* and 192*b*, and the facing surfaces 192*a* and 192*b* are angled in a direction towards the inner diameter of the wear ring. Similarly, each of the facing surfaces 193*a* and 193*b* are inwardly angled, such that each of the facing surfaces 193*a* and 193*b* defines an angle θ with a radial line extending through the center of the second portion 193. The radial line bisects the gap between the pair of facing surfaces 193*a* and 193*b*, and the facing surfaces 193*a* and 193*b* are angled in a direction towards the inner diameter of the wear ring. The wear ring 148 may be that described in PCT Application No. WO 2015/054776 to Robbins, the content of which is incorporated herein by reference in its entirety.

In use, the assembled piston 130 is installed onto the piston stem and is inserted into the piston bore 132. At the beginning of a stroke cycle, the piston is positioned at its starting position in the piston bore 132, and a volume of liquid metal is introduced into the piston bore 132 forward of the piston 130 via port 124. The piston is then moved forward through the piston bore 132 to push the volume of liquid metal into the mold cavity for forming a metal casting, and is then moved rearward to its starting position to complete the stroke cycle. During this movement, the wear ring 148 disposed on the piston 130 continuously contacts the inner surface 196 of the piston bore 132, and provides a liquid metal seal for preventing liquid metal from passing between the piston 130 and the inner surface 196 of the piston bore 132. The wear ring 148 also provides a vacuum seal for maintaining vacuum (that is, a low pressure) within the forward volume of the piston bore 132. During the cycle, cooling fluid delivered through the piston stem is circulated through the interior of the piston 130 via the internal conduit 162, the radial grooves 166, the annular channel 172, the annular volume 182, the ducts 184 and the internal conduit 164, to cool the piston 130. The stroke cycle is repeated, as desired, to produce multiple metal castings.

As will be appreciated, conventional piston heads and conventional piston bodies are fabricated of hot-worked tool steel, such as AISI grade H13 steel or DIN grade 1.2344 steel, as these tool steels are known to have high strength and high hardness during prolonged exposure to elevated temperatures (i.e. above 300° C.). The high strength and high hardness of hot-worked tool steels results from the high content of carbides, which are effective at impeding plastic deformation at elevated temperatures. However, at temperatures below 300° C., the carbides render hot-worked tool steel brittle, which increases the likelihood of thermal shock failure. As will be understood, materials having high hardness typically have low toughness, while materials having high toughness typically have low hardness.

The temperature of liquid metal used in die-casting, such as aluminum or aluminum alloy, is typically about 650° C. As a result, without cooling provided by cooling fluid, conventional piston heads and conventional piston bodies used for aluminum or aluminum alloy die-casting experience operational temperatures of about 600 to 650° C., namely in the elevated temperature range. In contrast, piston 130 is cooled during operation and, as a result, experiences operational temperatures of below 300° C., namely below the elevated temperature range.

As will be appreciated, fabricating the piston head 142 and the body 146 of tool steel having a high toughness and a high yield strength allows the portions of the piston 130 that contact or are in proximity with the liquid metal, but which do not contact the surface of the piston bore 132, to have increased resistance to thermal shock failure, as compared to conventional pistons having piston heads and bodies fabricated of other materials.

Additionally, and as will be appreciated, fabricating the wear ring 148 of hot-worked tool steel having a high hardness allows the portion of the piston 130 that contacts the surface of the piston bore 132 to have increased wear resistance, as compared to conventional pistons having wear rings fabricated of other materials.

As will be appreciated, the configuration of the baffle ribs with angularly offset cutouts and the baffle rings effectively provides a circuitous path for the cooling fluid within the interior of the piston, while the wider interfacial area between each baffle rib and its counterpart baffle ring increases thermal conduction and the strength and robustness of the piston as compared to conventional pistons comprising spiral or serpentine cooling channels separated by thin ribs.

These features advantageously allow the piston 130 to be more durable and to provide a longer service life than conventional die-casting pistons.

Figure 9:
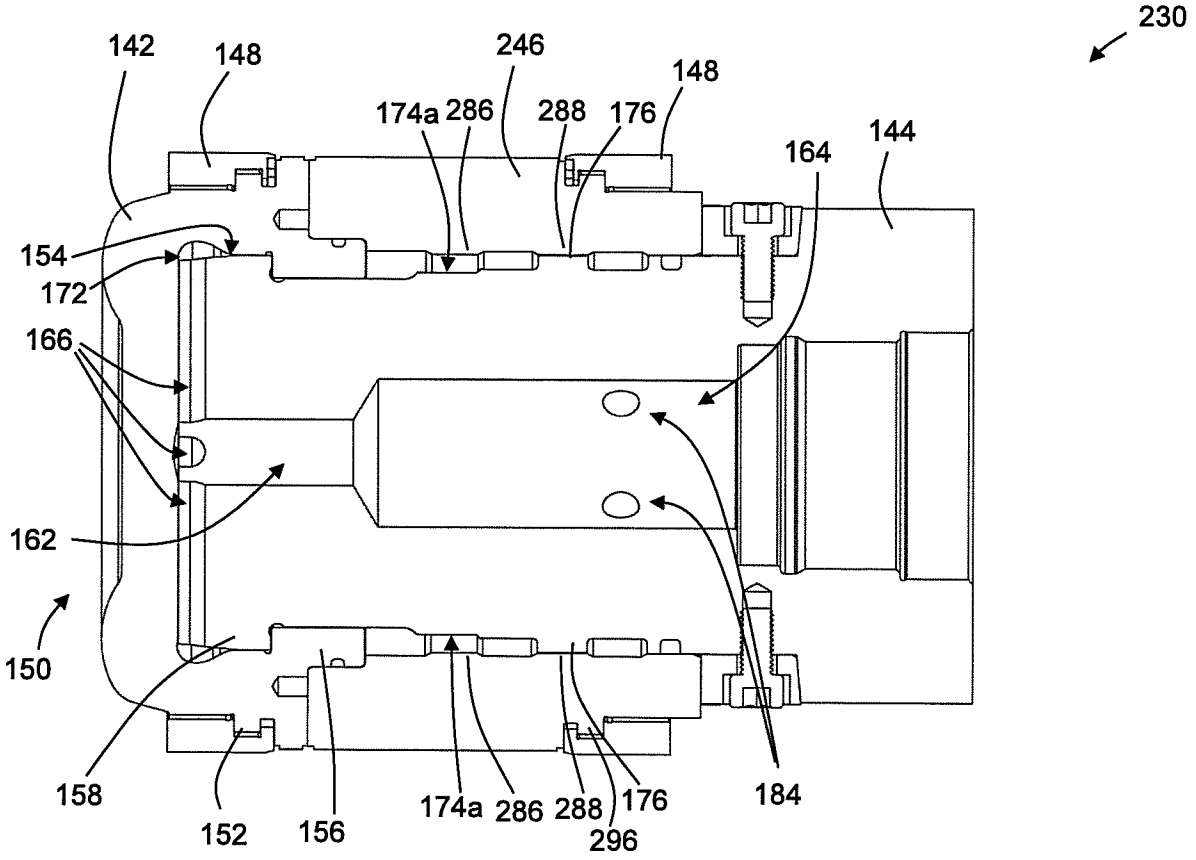
FIG. 9 is a sectional side view of another embodiment of a piston for use with the die-casting apparatus of FIG. 2.

Other configurations of the piston are possible. For example, FIG. 9 shows another embodiment of a piston for use with the die-casting apparatus 120, and which is generally indicated by reference numeral 230. Piston 230 is generally similar to piston 130 described above and with reference to FIGS. 3 to 8, and comprises the piston head 142, the inner piston carrier 144 coupled to the piston head 142, a piston body 246 seated on the carrier 144 and coupled to the piston head 142, and the replaceable wear ring 148 disposed on the outer surface of the piston head 142. The piston 230 further comprises a second replaceable wear ring 148 disposed on an outer surface of the piston body 246.

The body 246 is generally similar to body 146 described above and with reference to FIGS. 3 to 8, and has a generally annular shape having a forward surface configured to abut against the piston head 142 and a rear surface configured to abut against the collar 160 and the locking keys 161. The body 246 also has an inner surface that is generally spaced from an outer surface of the carrier 144, such that the body 246 and the carrier 144 define the annular volume 182 within the assembled piston 130. The annular volume 182 is in fluid communication with the annular channel 172 within the internal cavity 154 through gaps (not shown) between adjacent lugs 158, and through gaps (not shown) between adjacent lugs 156. The annular volume 182 is also in fluid communication with the rear internal conduit 164 through the ducts 184 within the carrier 144, for circulation of cooling fluid within the interior of the piston 130. The inner surface of the body 246 has two (2) inwardly projecting circumferential baffle rings, namely a first baffle ring 286 and a second baffle ring 288, formed thereon. The first and second baffle rings 286 and 288 are configured to abut the outer circumferential surfaces of the first and second circumferential baffle ribs 174 and 176, respectively, in the assembled piston 230. The baffle rib 174 and the baffle ring 286 provide a first fluid baffle having flow channels defined by cutouts 174*a*, and the baffle rib 176 and the baffle ring 288 provide a second fluid baffle having flow channels defined by cutouts 176*a*. As will be understood, the baffle rib 174 and the baffle ring 286 are coplanar around a full revolution about the longitudinal axis of the carrier 144, with the shared imaginary plane being perpendicular to the longitudinal axis. Similarly, the baffle rib 176 and the baffle ring 288 are coplanar around a full revolution about the longitudinal axis of the carrier 144, with the shared imaginary plane being perpendicular to the longitudinal axis. The body 246 also has a circumferential rib 296 and a circumferential groove formed on an outer surface thereof, for engaging the second wear ring 148 disposed thereon. The body 246 is fabricated of a tool steel that has a higher toughness and a higher yield strength than hot-worked tool steel, and in this embodiment the body 246 is fabricated of AISI grade 4340 steel.

Figure 10:
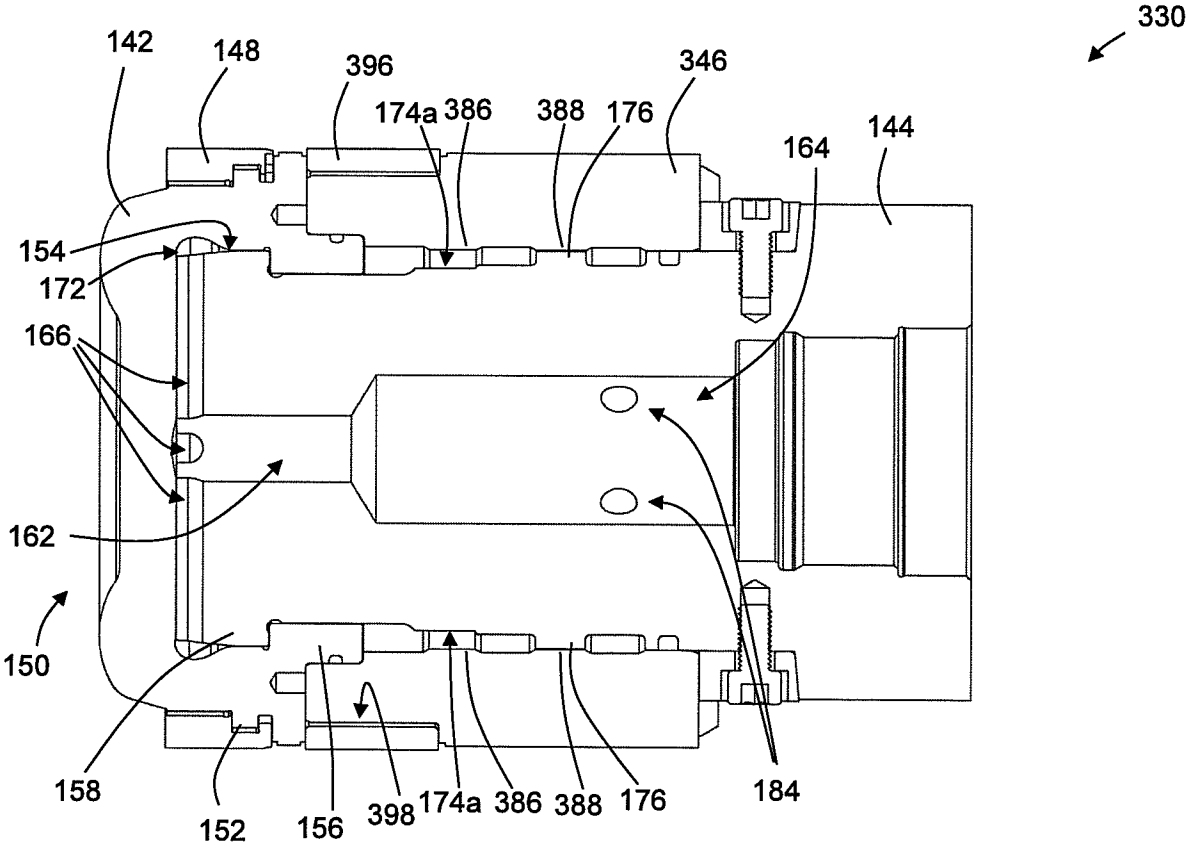
FIG. 10 is a sectional side view of still another embodiment of a piston for use with the die-casting apparatus of FIG. 2.

Still other configurations are possible. For example, FIG. 10 shows another embodiment of a piston for use with the die-casting apparatus 120, and which is generally indicated by reference numeral 330. Piston 330 is generally similar to piston 130 described above and with reference to FIGS. 3 to 8, and comprises the piston head 142, the inner piston carrier 144 coupled to the piston head 142, a piston body 346 seated on the carrier 144 and coupled to the piston head 142, and the replaceable wear ring 148 disposed on the outer surface of the piston head 142. The piston 330 further comprises a replaceable wear band 396 disposed on an outer surface of the piston body 346.

The body 346 is generally similar to body 146 described above and with reference to FIGS. 3 to 8, and has a generally annular shape having a forward surface configured to abut against the piston head 142 and a rear surface configured to abut against the collar 160 and the locking keys 161. The body 346 also has an inner surface that is generally spaced from an outer surface of the carrier 144, such that the body 346 and the carrier 144 define the annular volume 182 within the assembled piston 130. The annular volume 182 is in fluid communication with the annular channel 172 within the internal cavity 154 through gaps (not shown) between adjacent lugs 158, and through gaps (not shown) between adjacent lugs 156. The annular volume 182 is also in fluid communication with the rear internal conduit 164 through the ducts 184 within the carrier 144, for circulation of cooling fluid within the interior of the piston 330. The inner surface of the body 346 has two (2) inwardly projecting circumferential baffle rings, namely a first baffle ring 386 and a second baffle ring 388, formed thereon. The first and second baffle rings 386 and 388 are configured to abut the outer circumferential surfaces of the first and second circumferential baffle ribs 174 and 176, respectively, in the assembled piston 130. The baffle rib 174 and the baffle ring 386 provide a first fluid baffle having flow channels defined by cutouts 174*a*, and the baffle rib 176 and the baffle ring 388 provide a second fluid baffle having flow channels defined by cutouts 176*a*. As will be understood, the baffle rib 174 and the baffle ring 386 are coplanar around a full revolution about the longitudinal axis of the carrier 144, with the shared imaginary plane being perpendicular to the longitudinal axis. Similarly, the baffle rib 176 and the baffle ring 388 are coplanar around a full revolution about the longitudinal axis of the carrier 144, with the shared imaginary plane being perpendicular to the longitudinal axis. The body 346 also has a circumferential groove 398 formed on an outer surface thereof, for accommodating the replaceable wear band 396 disposed thereon. The body 346 is fabricated of a tool steel that has a higher toughness and a higher yield strength than hot-worked tool steel, and in this embodiment the body 346 is fabricated of AISI grade 4340 steel.

Figure 11:
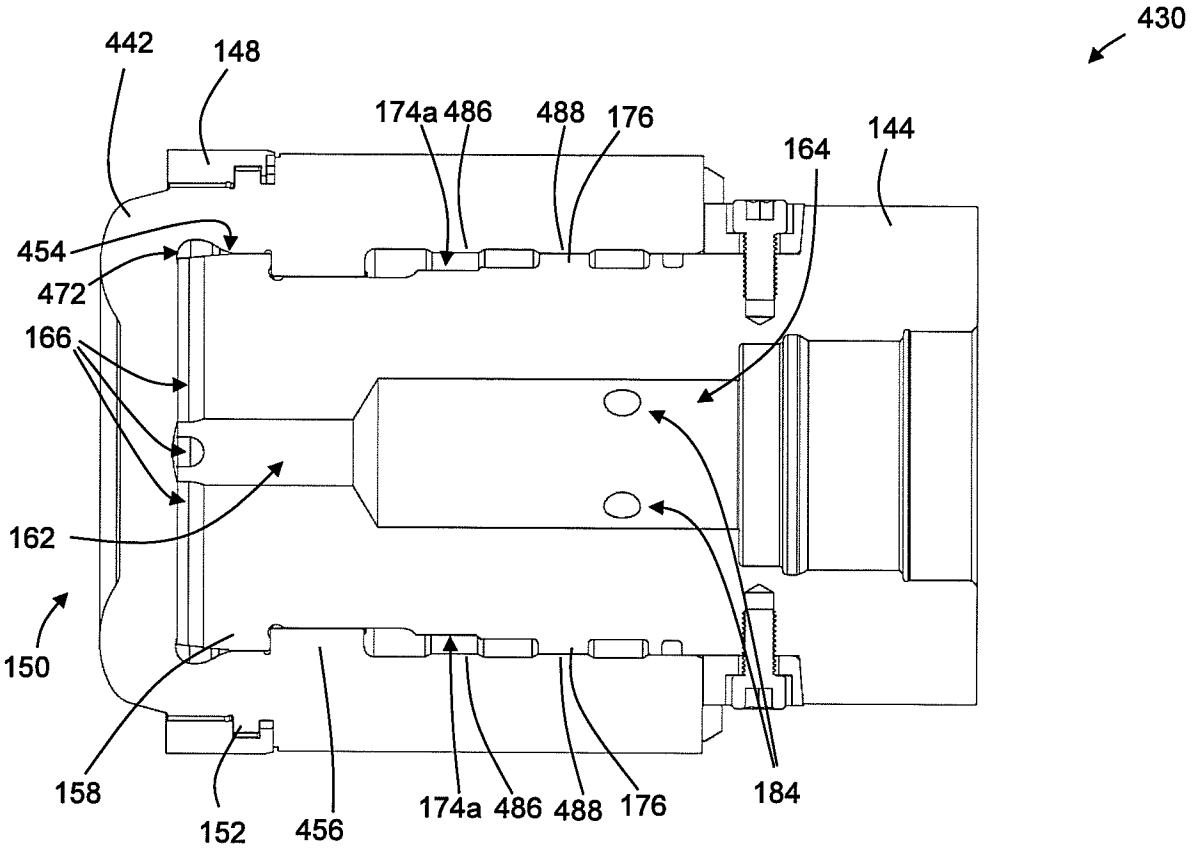
FIG. 11 is a sectional side view of yet another embodiment of a piston for use with the die-casting apparatus of FIG. 2.

Still other configurations are possible. For example, FIG. 11 shows another embodiment of a piston for use with the die-casting apparatus 120, and which is generally indicated by reference numeral 430. Piston 430 is generally similar to piston 130 described above and with reference to FIGS. 3 to 8, and comprises a piston head 442, the inner piston carrier 144 coupled to the piston head 442, and the replaceable wear ring 148 disposed on an outer surface of the piston head 442.

The piston head 142 has a front face 450 configured to contact the volume of liquid metal introduced into the piston bore 132 via port 136. In the embodiment shown, the front face 450 has a depression formed therein. The piston head 442 has a circumferential rib 452 and a circumferential groove formed on an outer surface thereof for engaging the wear ring 148. The piston head 442 defines an internal cavity 454, and has a set of inwardly projecting lugs 456 that are configured to provide a bayonet-style connection with the carrier 144.

The piston head 442 extends rearward to define a rear portion that effectively provides a body that is generally similar in shape to body 146 described above and with reference to FIGS. 3 to 8. In this manner, the rear portion of the piston head 442 has a generally annular shape having a rear surface configured to abut against the collar 160 and the locking keys 161. The rear portion of the piston head 442 also has an inner surface that is generally spaced from an outer surface of the carrier 144, such that the rear portion of the piston head 442 and the carrier 144 define the annular volume 182 within the assembled piston 430. The annular volume 182 is in fluid communication with an annular channel 472 within the internal cavity 454 through gaps (not shown) between adjacent lugs 158, and through gaps (not shown) between adjacent lugs 456. The annular volume 182 is also in fluid communication with the rear internal conduit 164 through the ducts 184 within the carrier 144, for circulation of cooling fluid within the interior of the piston 430. The inner surface of the rear portion of the piston head 442 has two (2) inwardly projecting circumferential baffle rings, namely a first baffle ring 486 and a second baffle ring 488, formed thereon. The first and second baffle rings 486 and 488 are configured to abut the outer circumferential surfaces of the first and second circumferential baffle ribs 174 and 176, respectively, in the assembled piston 430. The baffle rib 174 and the baffle ring 486 provide a first fluid baffle having flow channels defined by cutouts 174*a*, and the baffle rib 176 and the baffle ring 488 provide a second fluid baffle having flow channels defined by cutouts 176*a*. As will be understood, the baffle rib 174 and the baffle ring 486 are coplanar around a full revolution about the longitudinal axis of the carrier 144, with the shared imaginary plane being perpendicular to the longitudinal axis. Similarly, the baffle rib 176 and the baffle ring 488 are coplanar around a full revolution about the longitudinal axis of the carrier 144, with the shared imaginary plane being perpendicular to the longitudinal axis. The piston head 442 is fabricated of a tool steel that has a higher toughness and a higher yield strength than hot-worked tool steel, and in this embodiment the piston head 442 is fabricated of AISI grade 4340 steel.

Although in the embodiments described above, the piston head and the body are fabricated of AISI grade 4340 steel, in other embodiments, one or both of the piston head and the body may alternatively be fabricated of AISI grade 300M steel or AISI grade 4140 steel, or of any non-AISI equivalent of AISI grade 4340, 300M or 4140 steel. In still other embodiments, one or both of the piston head and the body may alternatively be fabricated of any shock-resistant tool steel having a higher toughness and a higher yield strength than hot-worked tool steel.

In other embodiments, one or both of piston head and the body may alternatively be fabricated of a tool steel having the following composition (expressed in weight percentage): from about 0.32% to about 0.48% carbon (C); from about 0.50% to about 1.50% chromium (Cr); from about 0.40% to about 1.30% manganese (Mn); and from 0.05% to about 0.90% molybdenum (Mo), the balance being mainly constituted by Iron (Fe), with optional other alloying elements and inevitable impurities. However, the composition of the tool steel is not limited to any specific, single composition. Preferably, the composition of the tool steel comprises from about 0.36% to about 0.48% C. More preferably, the composition of the tool steel comprises from about 0.37% to about 0.46% C. Preferably, the composition of the tool steel comprises from about 0.70% to about 1.10% Cr. More preferably, the composition of the tool steel comprises from about 0.70% to about 0.95% Cr. Preferably, the composition of the tool steel comprises from about 0.50% to about 1.10% Mn. More preferably, the composition of the tool steel comprises from about 0.60% to about 1.00% Mn. Preferably, the composition of the tool steel comprises from about 0.10% to about 0.80% Mo. More preferably, the composition of the tool steel comprises from about 0.15% to about 0.65% Mo.

Although in the embodiments described above, the piston head and the body are fabricated of the material having higher toughness and a higher yield strength than hot-worked tool steel, in other embodiments, only the piston head may alternatively be fabricated of the material having higher toughness and a higher yield strength than hot-worked tool steel.

Although in the embodiments described above, the entire piston head is fabricated of the material having higher toughness and a higher yield strength than hot-worked tool steel, in other embodiments, only a portion of the piston head that contacts the liquid metal may alternatively be fabricated of the material having higher toughness and a higher yield strength than hot-worked tool steel.

Although in the embodiments described above, the carrier comprises two (2) baffle ribs and the body comprises two (2) baffle rings, in other embodiments, the carrier may alternatively comprise only one (1) baffle rib and the body may alternatively comprise only one (1) baffle ring, or the carrier may alternatively comprise more than two (2) baffle ribs and the body may alternatively comprise more than two baffle rings.

Although in the embodiments described above, each baffle ring comprises two (2) cutouts, in other embodiments, each baffle ring may alternatively comprise only one (1) cutout or more than two (2) cutouts.

The following examples illustrate various applications of the above-described embodiments.

EXAMPLE 1

Figure 12:
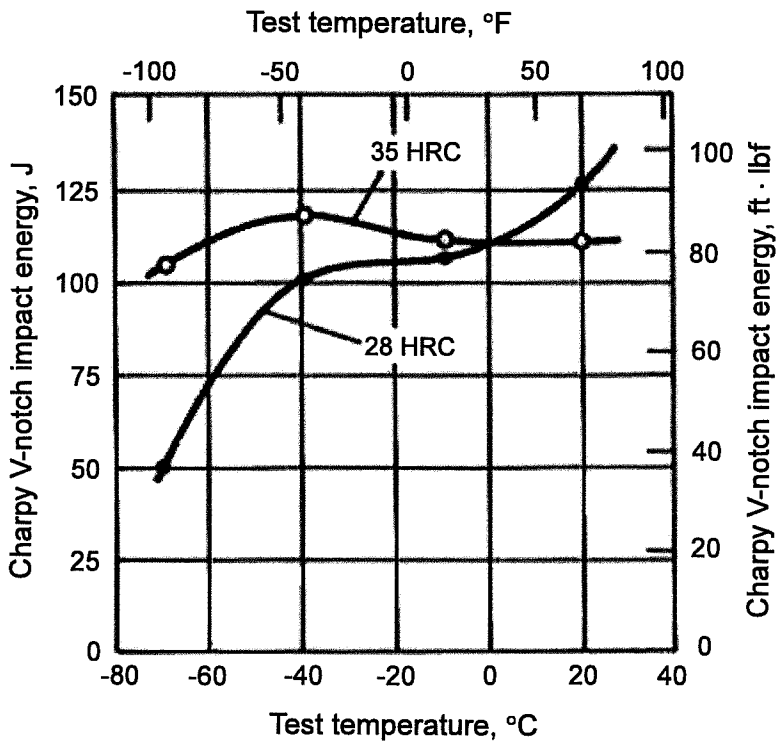
FIG. 12 is a graphical plot of impact energy as a function of test temperature for AISI grade 4340 steel, of which one or more parts of the piston of FIG. 2 may be fabricated.

FIG. 12 is a graphical plot of impact energy as a function of test temperature for AISI grade 4340 steel, of which the piston head 142 and the piston body 146 are fabricated.

As can be seen, the room temperature impact energy of AISI grade 4340 steel hardened to 35 Rockwell Hardness C ("HRC") and to 28 HRC is about 110 J and about 130 J, respectively.

Figure 13A:
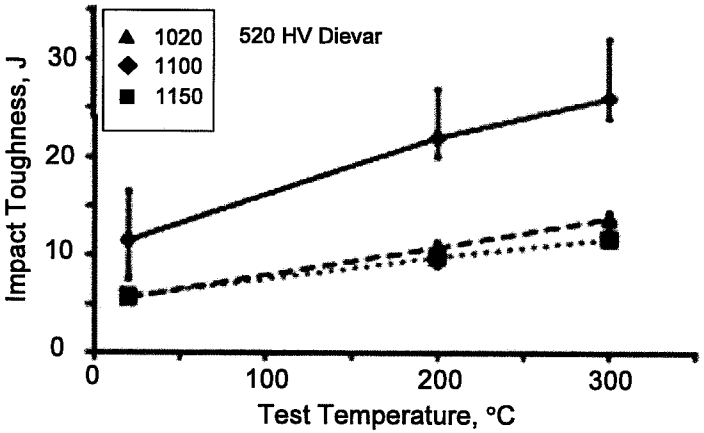
FIGS. 13A, 13B and 13C are graphical plots of impact energy as a function of test temperature for conventional hot-worked tool steels.
Figure 13B:
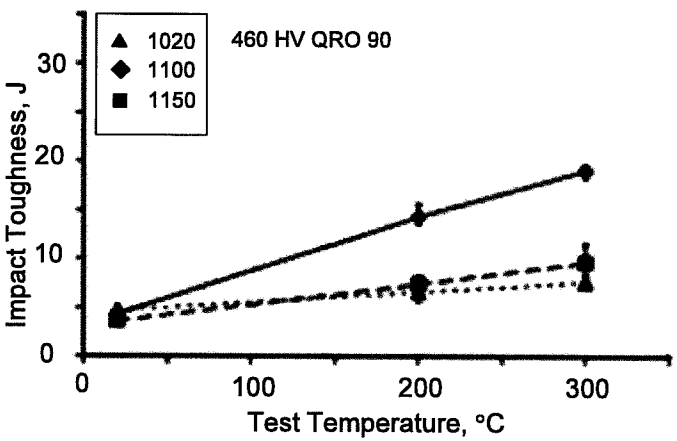
Figure 13C:
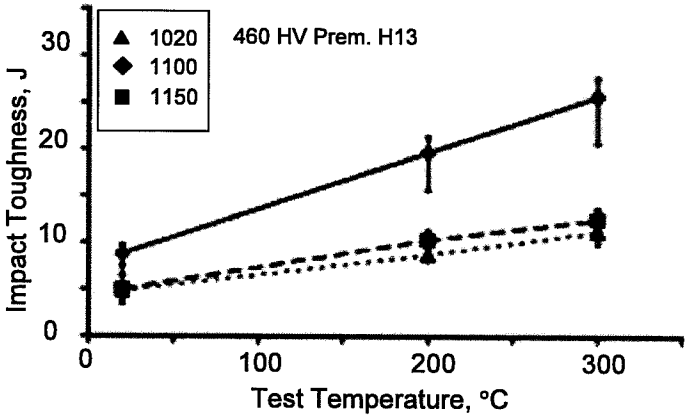

In contrast, FIGS. 13A, 13B and 13C are graphical plots of impact energy as a function of test temperature for several common hot-worked tool steels, namely 520 Vickers Hardness ("HV") Dievar steel, 460 HV grade QRO 90 steel, and 460 HV Premium grade H13 steel, respectively. As can be seen, the room temperature impact energy of 520 HV, 460 HV QRO 90, and 460 HV Premium H13 steels are about 5 to 12 J, about 4 J, and about 5 to 10 J, respectively.

As will be appreciated, the room temperature impact energy, and therefore the toughness, of AISI grade 4340 steel is at least eight (8) times greater than that of common hot-worked tool steels.

EXAMPLE 2

Figure 14B:
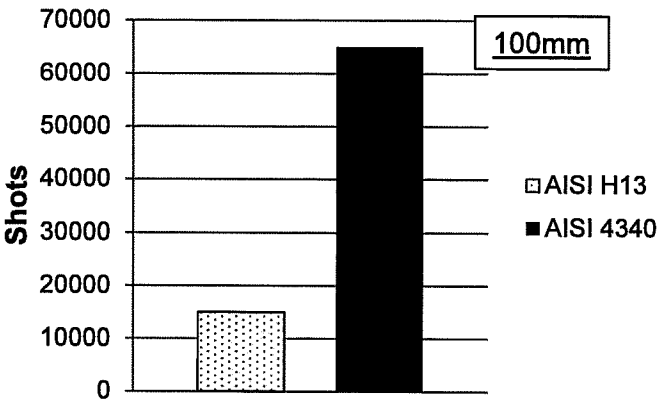
FIGS. 14A, 14B and 14C are graphical plots of number of stroke cycles until failure, for exemplary pistons of 60, 100 and 180 mm sizes, as a function of steel grade of which the piston is fabricated.
Figure 14A:
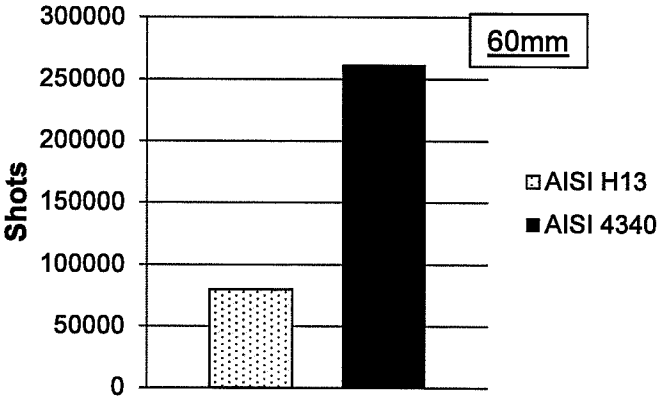

Two (2) pistons generally similar to piston 130 described above, and having a diameter of 60 mm, were fabricated. The first piston comprised a piston head and a body fabricated of AISI grade H13 steel, and the second piston comprised a piston head and a body fabricated of AISI grade 4340 steel. Both pistons were subjected to identical operating conditions in a vacuum-assisted die-casting apparatus. Cracking was observed in the piston head fabricated of AISI grade H13 steel after 80,000 "shots" (namely, stroke cycles using liquid metal), while no cracking was observed in the piston head fabricated of AISI grade 4340 steel after more than 262,000 shots. The results of this comparison are shown in FIG. 14A.

Similarly, two (2) pistons generally similar to piston 130 described above, and having a diameter of 100 mm, were fabricated. The first piston comprised a piston head and a body fabricated of AISI grade H13 steel, and the second piston comprised a piston head and a body fabricated of AISI grade 4340 steel. Both pistons were subjected to identical operating conditions in a vacuum-assisted die-casting apparatus. Cracking was observed in the piston head fabricated of AISI grade H13 steel after 15,000 shots, while no cracking was observed in the piston head fabricated of AISI grade 4340 steel after more than 65,000 shots. The results of this comparison are shown in FIG. 14B.

Figure 14C:
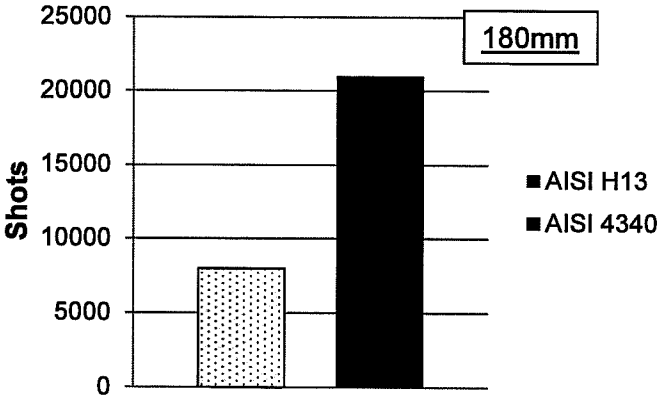

Similarly, two (2) pistons generally similar to piston 130 described above, and having a diameter of 180 mm, were fabricated. The first piston comprised a piston head and a body fabricated of AISI grade H13 steel, and the second piston comprised a piston head and a body fabricated of AISI grade 4340 steel. Both pistons were subjected to identical operating conditions in a vacuum-assisted die-casting apparatus. Cracking was observed in the piston head fabricated of AISI grade H13 steel after 8,000 shots, while no cracking was observed in the piston head fabricated of AISI grade 4340 steel after more than 21,000 shots. The results of this comparison are shown in FIG. 14C.

Although embodiments have been described above with reference to the accompanying drawings, those of skill in the art will appreciate that variations and modifications may be made without departing from the scope thereof as defined by the appended claims.

What is claimed is:

1. A piston of a die-casting apparatus, the piston comprising:

a piston head having a front face, the piston head and the front face being fabricated of a first material;

an elongate, inner carrier coupled to the piston head;

a generally annular body seated on the carrier adjacent the piston head; and a wear ring disposed on the piston head, the wear ring being fabricated of a second material, the first material having a higher toughness and a lower hardness than the second material, wherein the first material is AISI grade 4340 steel or AISI grade 300M steel, or any compositional equivalent thereof.

2. The piston of claim 1, wherein the body is fabricated of the first material.

3. The piston of claim 1, wherein the first material is shock-resistant tool steel.

4. The piston of claim 1, wherein the second material is hot-worked tool steel.

5. The piston of claim 1, wherein the second material is AISI grade H13 steel or DIN grade 1.2344 steel.

6. The piston of claim 1, wherein the carrier comprises a circumferential baffle rib formed on an outer surface thereof, the baffle rib having at least one cutout formed therein and sized to allow cooling fluid to flow therethrough.

7. The piston of claim 6, wherein the carrier comprises a first baffle rib having at least one first cutout formed therein, and a second baffle rib comprising at least one second cutout formed therein, the at least one first cutout being angularly offset relative to the at least one second cutout about a longitudinal axis of the carrier.

8. The piston of claim 7, wherein the body comprises a first inwardly projecting circumferential baffle ring configured to abut an outer circumferential surface of the first baffle rib to provide a first fluid baffle, and a second inwardly projecting circumferential baffle ring configured to abut an outer circumferential surface of the second baffle rib to provide a second fluid baffle.

9. The piston of claim 8, wherein the first baffle rib and the first baffle ring are coplanar around a full revolution about a longitudinal axis of the carrier, and the second baffle rib and the second baffle ring are coplanar around a full revolution about the longitudinal axis of the carrier.

10. The piston of claim 9, wherein the first baffle rib and the first baffle ring define a first shared plane that is perpendicular to the longitudinal axis, and wherein the second baffle rib and the second baffle ring define a second shared plane that is perpendicular to the longitudinal axis.

11. The piston of claim 6, wherein the body comprises an inwardly projecting circumferential baffle ring configured to abut an outer circumferential surface of the baffle rib to provide a fluid baffle.

12. The piston of claim 11, wherein the baffle rib and the baffle ring are coplanar around a full revolution about a longitudinal axis of the carrier.

13. The piston of claim 12, wherein the baffle rib and the baffle ring define a shared plane that is perpendicular to the longitudinal axis.

14. The piston of claim 1, wherein the body has an additional wear ring disposed thereon.

15. The piston of claim 1, wherein the body has a wear band disposed thereon.

16. The piston of claim 1, wherein the piston head and the body have a unitary construction.

17. The piston of claim 16, wherein the piston head and the body are fabricated of a single piece of the first material.

18. A die-casting apparatus comprising the piston of claim 1.

19. A piston of a die-casting apparatus, the piston comprising:

a piston head fabricated of a first material;

an elongate, inner carrier coupled to the piston head;

a generally annular body seated on the carrier adjacent the piston head; and a wear ring disposed on the piston head, the wear ring being fabricated of a second material, the first material having a higher toughness and a lower hardness than the second material, wherein the first material is AISI grade 4340 steel or AISI grade 300M steel.

* * * * *